US011566540B2

(12) United States Patent
Bomberault et al.

(10) Patent No.: US 11,566,540 B2
(45) Date of Patent: Jan. 31, 2023

(54) TURBOMACHINE RING

(71) Applicant: SAFRAN AIRCRAFT ENGINES, Paris (FR)

(72) Inventors: Quentin Pierre Hubert Bomberault, Moissy-Cramayel (FR); Martin Jubien, Moissy-Cramayel (FR); Julien Michel Auguste Robert, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/962,026

(22) PCT Filed: Jan. 9, 2019

(86) PCT No.: PCT/FR2019/050035

§ 371 (c)(1),
(2) Date: Jul. 14, 2020

(87) PCT Pub. No.: WO2019/141918

PCT Pub. Date: Jul. 25, 2019

(65) Prior Publication Data

US 2020/0392871 A1 Dec. 17, 2020

(30) Foreign Application Priority Data

Jan. 16, 2018 (FR) ..... 1800060

(51) Int. Cl.
*F01D 9/04* (2006.01)
*F01D 25/24* (2006.01)
*F01D 11/08* (2006.01)

(52) U.S. Cl.
CPC ..... *F01D 25/246* (2013.01); *F01D 9/04* (2013.01); *F01D 11/08* (2013.01);
(Continued)

(58) Field of Classification Search
CPC ..... F01D 9/04; F01D 9/042; F01D 25/246; F01D 11/005; F01D 11/08; F01D 11/003;
(Continued)

(56) References Cited

U.S. PATENT DOCUMENTS 4,980,241 A * 12/1990 Hoffmueller ..... F01D 5/30 428/607
8,899,914 B2 * 12/2014 Ring ..... F01D 9/042 415/119

(Continued)

FOREIGN PATENT DOCUMENTS

EP 2613021 A2 7/2013
GB 2477825 A 8/2011

OTHER PUBLICATIONS

International Search Report in PCT/FR2019/050035 dated Apr. 8, 2019, (4 pages).

*Primary Examiner* — Eldon T Brockman
*Assistant Examiner* — Maxime M Adjagbe
(74) *Attorney, Agent, or Firm* — Bookoff McAndrews, PLLC

(57) ABSTRACT

Turbomachine ring as well as a turbomachine comprising such a ring and a method for repairing such a ring, the turbomachine ring comprising an essentially cylindrical support, including a frontal surface wherein a notch is formed, one or more sectors forming an annulus configured to embody a segment of air stream, each sector comprising a hook portion protruding in the direction of the support and engaging in the notch of the support, and an anti-wear device having a U shaped portion, provided in the notch of the support and pressed at least against the radially external surface of the notch, and a tab portion, continuously extending the U shaped portion, pressed and fastened against the frontal surface of the support.

18 Claims, 2 Drawing Sheets

(52) U.S. Cl.
CPC .... *F05D 2220/323* (2013.01); *F05D 2230/80* (2013.01); *F05D 2260/38* (2013.01)

(58) Field of Classification Search
CPC ..... F01D 11/006; F01D 11/008; F01D 11/00; F05D 2230/80
See application file for complete search history.

(56) References Cited

U.S. PATENT DOCUMENTS

| | | | | |
|---|---|---|---|---|
| 2004/0052637 | A1* | 3/2004 | Paprotna | F01D 11/005 415/170.1 |
| 2007/0231150 | A1* | 10/2007 | Dervaux | F01D 11/005 416/224 |
| 2012/0128481 | A1* | 5/2012 | Baumas | F01D 9/042 415/209.2 |
| 2013/0209249 | A1* | 8/2013 | Langlois | F01D 9/042 415/209.3 |
| 2014/0241874 | A1 | 8/2014 | Rioux | |
| 2017/0130859 | A1* | 5/2017 | Fluehs | F02M 63/0017 |

* cited by examiner

TURBOMACHINE RING

CROSS-REFERENCE TO RELATED APPLICATION(S)

This application is the U.S. National Phase entry under 35 U.S.C. § 371 of International Application No. PCT/FR2019/050035, filed Jan. 9, 2019, which claims the benefit of priority to French Patent Application No. 1800060, filed on Jan. 16, 2018.

FIELD OF THE INVENTION

The present disclosure relates to a turbomachine ring as well as a turbomachine comprising a ring of this type and a method for repairing a ring of this type. It can in particular involve a compressor or turbine ring of an aircraft engine, with single or dual flow.

STATE OF THE PRIOR ART

In numerous turbomachine compressors, but also in certain turbines, the fixed vanes are mounted on sectors forming an annulus embodying the air stream: these sectors are then mounted on the casing of the stator by means of hook portions engaging in notches of a stator support.

However, during the operation of the turbomachine, due in particular to the vibrations undergone by the sectors of the ring, the hooks of the sectors rub against and wear the notches of the support: an erosion of the inner faces of the notches is thus sometimes observed. Naturally, erosion of this type modifies the chains of dimensions between the parts of the ring, opening the clearances in particular and moving the parts, which can cause leakage and generate loss of performance.

Henceforth it is desired to be able to repair the notches without replacing the totality of the support.

One repair option that can be considered would be to locally refill the material of the notch, either by thermal spraying or by welding or brazing. However, such solutions are difficult to accomplish due to the difficulty of access to the zone to be reworked and to the geometry of the zone to be refilled.

Another option that can be considered would be to fasten an element of the band type to each face of the notch to be repaired. However, it is difficult to thus coat the complete stream. In fact, coating brings about excessive dimensional dispersions; furthermore, the temperature tolerance of the resins is not sufficient in the context of application to a turbomachine.

There exists therefore a real need for a turbomachine ring, as well as a turbomachine comprising a ring of this type and a method for repairing a ring of this type, which are lacking, at least in part, the disadvantages inherent in the aforementioned known methods.

PRESENTATION OF THE INVENTION

The present disclosure relates to a turbomachine ring, comprising an essentially cylindrical support, including a frontal surface in which is formed a notch, one or more sectors forming an annulus configured to embody a segment of air stream, each sector comprising a hook portion protruding in the direction of the support and engaging in the notch of the support, and an anti-wear device having a U shaped portion, provided in the notch of the support and pressed at least against the radially external surface of the notch, and a tab portion, continuously extending the U shaped portion, pressed and fastened against the frontal surface of the support.

Thanks to an anti-wear device of this type, it is possible to easily and effectively repair a worn support notch. It is also possible to install an anti-wear device of this type at the outset in order to facilitate the maintenance of the turbomachine. In fact, thanks to an anti-wear device of this type, in the event of friction or vibrations between the sector and the support, the notch of the support is protected, only the anti-wear device wearing if necessary. But the anti-wear device can be easily replaced, which drastically reduces the time and cost of repair.

Furthermore, thanks to the tab portion pressed and fastened against the frontal surface of the support, it is possible to effectively retain the anti-wear device in the pressed position within the notch while still offering increased accessibility allowing facilitated fastening and removal of the anti-wear device.

The fact of fastening the anti-wear device to the support also allows simplifying the nomenclature of the parts of the turbomachine and the logistics associated with maintenance: in fact, this allows avoiding assigning an individual reference symbol to the anti-wear device.

In certain embodiments, the U shaped portion of the anti-wear device is under elastic constraint. This allows ensuring permanent placing of the U shaped portion against the radially external surface of the notch.

In certain embodiments, the radially internal wall of the U shaped portion of the anti-wear device forms, at rest, a first angle comprised between 5° and 20°, preferably between 10° and 15°, with the direction of the radially external wall of the U shaped portion. In other words, an angle of this type appears when the anti-wear device is not inserted into the notch, for example before the repair of the support or after its extraction. An angle of this type is measured in an axial plane. It allows generating the elastic constraint mentioned above when the anti-wear device is placed in the notch.

In certain embodiments, the tab portion of the anti-wear device is under elastic constraint. This allows returning the U shaped portion of the anti-wear device to the bottom of the notch, thus stabilizing its position.

In certain embodiments, the tab portion of the anti-wear device forms, at rest, a second angle comprised between 5° and 20°, preferably between 10° and 15°, with the direction orthogonal to the radially external wall of the U shaped portion. In other words, an angle of this type appears when the anti-wear device is not inserted into the notch, for example before the repair of the support or after its extraction. An angle of this type is measured in the axial plane. It allows generating the elastic constraint mentioned above when the anti-wear device is placed inside the notch.

In certain embodiments, the tab portion of the anti-wear device is, at rest, substantially orthogonal to the radially internal wall of the U shaped portion.

In certain embodiments, the tab portion of the anti-wear device continuously extends the U shaped portion inward. Thus, the tab portion is fastened to the radially interior zone of the frontal surface of the support. This facilitates access to the anti-wear device from the inside of the ring, helps press the U shaped portion of the anti-wear device against the radially external surface of the notch, and protects the frontal surface of the support from friction with the ring sector.

In certain embodiments, a space is left between the U shaped portion of the anti-wear device and the bottom of the notch of the support. This space allows sliding a tool between the anti-wear device and the bottom of the notch in order to facilitate the extraction of the anti-wear device.

In certain embodiments, a space is left between the U shaped portion of the anti-wear device and at least one portion of the radially internal surface of the notch of the support. This reinforces the pressing of the U shaped portion of the anti-wear device against the radially external surface of the notch of the support.

In certain embodiments, the tab portion of the anti-wear device is fastened to the frontal surface of the support by fastening points. These fastening points can have a diameter less than 1 mm, even 0.5 mm. This facilitates the fastening of the anti-wear device but also its removal, such fastening points being easy to break.

In certain embodiments, the fastening points are regularly distributed along the tab portion of the anti-wear device, particularly in the circumferential direction.

In certain embodiments, an angular distance of at least 15°, preferably 20°, separates two fastening points. Separating the fastening points allows facilitating the breaking of the fastening points and therefore the removal of the anti-wear device.

In certain embodiments, the tab portion of the anti-wear device is fastened to the frontal surface of the support by welding. It can in particular involve capacitor discharge welding points. Indeed, welding resists the elevated operating temperatures of the turbomachine and causes only slight dimensional dispersions.

In certain embodiments, the anti-wear device is separable from the support under the influence of a manual pull-out force. Thus this involve a light pull-out force for an operator, which allows easy and rapid maintenance. In particular, it is possible to separate the anti-wear device by simple lever action by inserting a tool, such as the tip of a screwdriver for example, between the anti-wear device and the support.

In certain embodiments, the thickness of the anti-wear device is comprised between 0.1 mm and 1 mm, preferably between 0.2 mm and 0.6 mm. This is compatible with the usual size of the notches of turbomachine ring supports.

In certain embodiments, the thickness of the anti-wear device is changeable. In fact, it is preferable to reserve a greater thickness in the zones of the notch against which the sector is caused to rub and a smaller thickness in the other zones, to reduce the probability of an accidental contact with the sector. Thus, in particular, the thickness of the radially internal wall of the U shaped portion of the anti-wear device can be less than the thickness of the radially external wall of the U shaped portion.

In certain embodiments, the anti-wear device has a hardness less than that of the support. This allow preferential wear of the anti-wear device relative to the support, thus preserving the support.

In certain embodiments, the anti-wear device has a hardness less than that of the hook of the sector. This allows preferential wear of the anti-wear device relative to the hook of the support, thus preserving the hook of the support.

In certain embodiments, the anti-wear device is made of Inconel.

In certain embodiments, the anti-wear device comprises a base element taking the form of a section, preferably of the foil-like type. This foil is preferably metallic. This base element can have any number of features among those mentioned above.

In certain embodiments, the anti-wear device also comprises an additional element, in the shape of a U, provided in the interior of the U shaped portion of the base element. This additional element can have any number of features among those mentioned above. It is thus possible to dissociate certain functions of the base element and of the additional element and/or offer differentiated behavior relative to the support, on the one hand, and to the hook of the sector on the other hand. In particular, the base element can ensure the mechanical functions of positioning and of fastening of the anti-wear device while the additional element can ensure the functions of preferential wear henceforth protecting the hook of the sector and the notch of the support.

In certain embodiments, the additional element takes the form of a section, preferably of the foil-like type, preferably metallic, distinct from the base element. The additional element can therefore be manufacture independently of the base element, then assembled with the latter.

In certain embodiments, the additional element is under elastic constraint. This allows pressing the additional element against the radially external surface of the U shaped portion of the base element.

In certain embodiments, the additional element takes the form of a coating deposited on the base element. The anti-wear device is thus one-piece.

In certain embodiments, the base element and the additional element form two layers of the same section, preferably of the foil-like type. The anti-wear device is thus one-piece.

In certain embodiments, the thickness of the additional element is comprised between 0.1 and 0.4 mm, preferably between 0.1 and 0.3 mm.

In certain embodiments, the additional element has a hardness less than that of the base element. This allows preferential wear of the additional element relative to the support, the base element retaining greater mechanical strength.

In certain embodiments, the additional element is made of an alloy based on nickel and/or cobalt. It can be equipped with an anti-wear coating, for example a deposit based on nickel and/or chromium.

In certain embodiments, the anti-wear device is divided into sectors. Each sector can in particular extend over an angular sector comprised between 30 and 60°.

In certain embodiments, the hook of the sector is pressed against the radially external surface of the anti-wear device. It is understood that this is accomplished at least during operation.

In certain embodiments, the ring is part of the compressor, preferably a high-pressure compressor. It could also be a turbine ring. It can just as well be integrated into a turbomachine with single or double flow.

The present disclosure also relates to a turbomachine comprising a turbomachine ring according to any one of the preceding embodiments.

The present disclosure also relates to a method for repairing a turbomachine ring, the turbomachine ring comprising an essentially cylindrical support, including a frontal surface in which a notch is formed, said notch having been at least partially eroded, and one or more sectors forming an annulus configured to embody a segment of air stream, each sector comprising a hook portion protruding in the direction of the support and engaging in the notch of the support, the repair method comprising the following steps: machining the internal walls of the notch; placing an anti-wear device having a U shaped portion and a tab portion, into the notch thus machined; fastening of the tab portion of the anti-wear device to the frontal surface of the support.

In certain embodiments, the anti-wear device conforms to any one of the embodiments presented above.

In the present disclosure, the terms "axial," "radial," "tangential," "proximal," "distal," and their derivatives are defined relative to the main axis of the turbomachine; what is meant by an "axial plane" is a plane passing through the main axis of the turbomachine, and by "radial plane" a plane perpendicular to this main axis; a "frontal" surface is inscribed in a radial plane; finally, the terms "upstream" and "downstream" are defined relative to the circulation of air in the turbomachine.

The aforementioned features and advantages, as well as others, will appear upon reading the detailed description that follows, of embodiments of the turbomachine ring and of the method proposed. This detailed description refers to the appended drawings.

BRIEF DESCRIPTION OF THE DRAWINGS

The appended drawings are schematic and air intended primarily to illustrate the principles of the disclosure.

In these drawings, from one figure (FIG) to another, identical elements (or parts of elements) are labeled by the same reference symbols. In addition, elements (or parts of elements) belonging to different exemplary embodiments but having similar functions are labeled in these figures by identical numerical references incremented by 100, 200, etc.

DETAILED DESCRIPTION OF EMBODIMENT(S)

In order to make the disclosure more concrete, examples of turbomachine rings are described in detail hereafter, with reference to the appended drawings. It is recalled that the invention is not limited to these examples.

Figure 1:
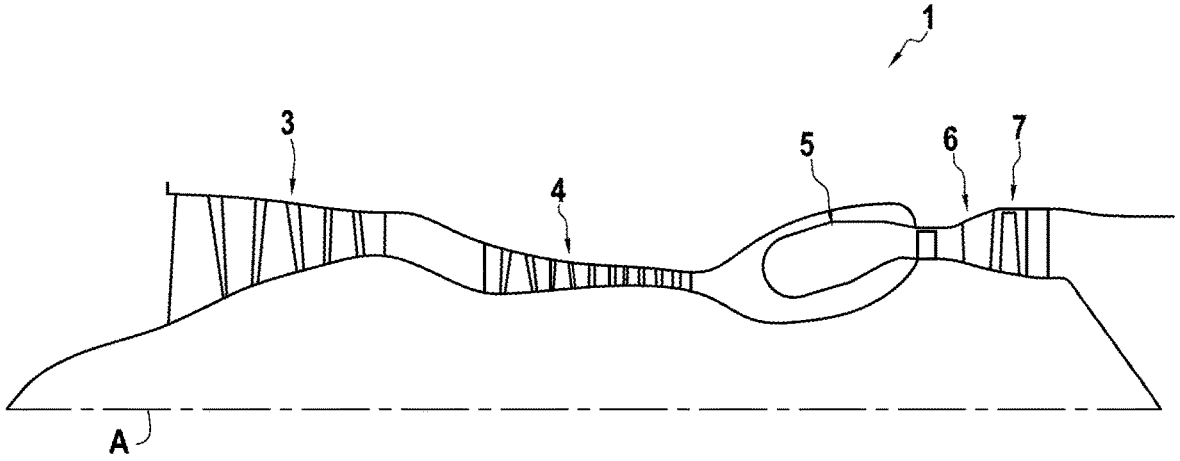
FIG. 1 is a section plan of a turbomachine according to the disclosure.

FIG. 1 shows in section along a vertical plane passing through its main axis A, a single flow turbojet 1 according to the disclosure. It includes, from upstream to downstream according to the circulation of the air flow, a low-pressure compressor 3, a high-pressure compressor 4, a combustion chamber 5, a high-pressure turbine 6 and a low-pressure turbine 7.

Figure 2:
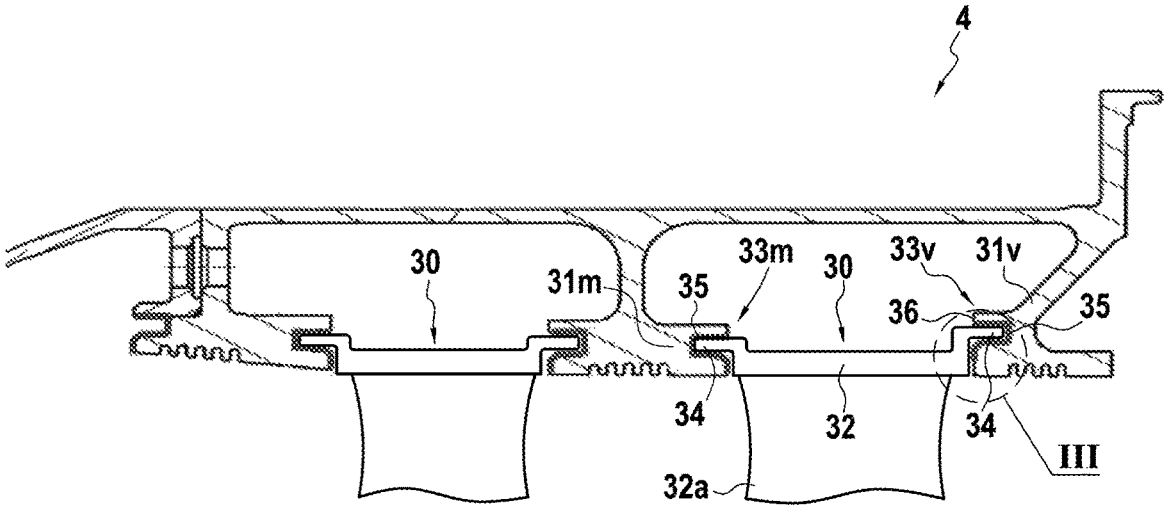
FIG. 2 is a section view of a first example of a turbomachine ring.

FIG. 2 illustrates a portion of the stator of the high-pressure compressor 4. In this figure, two compressor ring 30 according to a first embodiment are visible. Each compressor ring 30 comprises an upstream ring support 31*m* and a downstream ring support 31*v*, generally cylindrical, and forming an integral part of the casing of the compressor 4: each of them forms a stream wall facing an impeller. Each compressor ring 30 also comprises an annular of ring sectors 32 fastened to the ring supports 31*m*, 31*v*: they complete the air stream wall of the compressor 4 and carry fixed vanes 32*a*.

Each ring sector 32 is fastened to the ring supports 31*m*, 31*v* by means of hooking devices 33*m* and 33*v* provided at each axial end of the ring sector 32.

More precisely, each ring sector 32 comprises, at each of its axial ends, a hook 34 extending in the direction of the adjacent support 31*m*, 31*v* and penetrating into a notch 35 of the support 31*m*, 31*v*.

Figure 3:
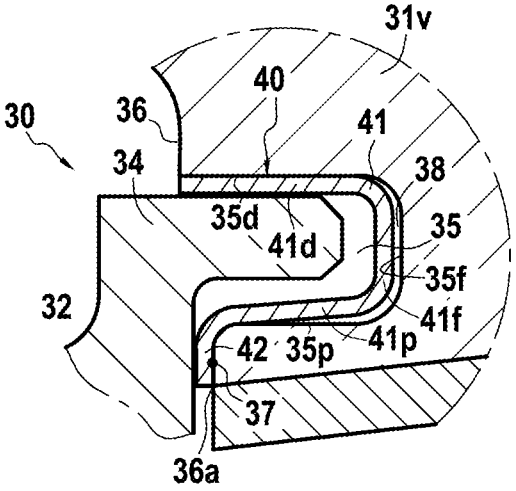
FIG. 3 is an enlargement of zone III of FIG. 2.

As is more visible in FIG. 3, the notch 35 is made in the frontal surface 36 of each support 31*m*, 31*v*: it extends continuously in the circumferential direction; its radially external 35*s* and radially internal 35*p* walls are parallel.

Figure 4:
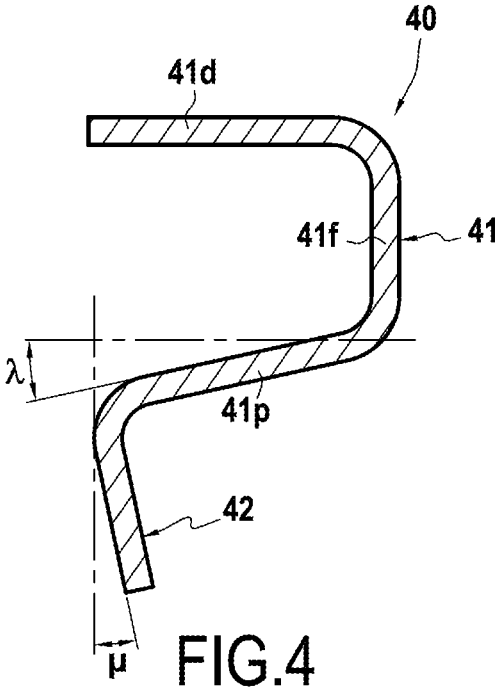
FIG. 4 is a section view of the anti-wear device of the first example.

An anti-wear device 40 is placed in this notch 35. The anti-wear device 40, visible in FIG. 4 in its initial rest state, comprises a U-shaped portion 41 and a tab portion 42. The anti-wear device 40 is a circular arc section extending continuously and invariantly in the circumferential direction: in FIG. 4, it is shown in section along a transverse plane, i.e. an axial plane in the frame of reference of the turbomachine 1. In the present example, the anti-wear device 40 is divided into sectors, each sector extending in an arc of the same length; however, in other examples, it could be completely annular, split or not. In the present example, the anti-wear device 40 is made of a nickel- and/or cobalt-based alloy provided with an anti-wear coating: it has a hardness less than both the support 31*m*, 31*v* and the hook 34 of the sector 32.

The U shaped portion 41 comprises a radially external wall 41*d*, a bottom wall 41*f* and a radially internal wall 41*p* arranged substantially in the shape of a U with relative to one another. More precisely, the bottom wall 41*f* continues the radially external wall 41*d* orthogonally. By contrast, the radially internal wall, continuing the bottom wall 41*f*, forms a nonzero angle λ relative to the direction of the radially external wall 41*d*, i.e. the axial direction. In the present example, this angle λ is approximately 12°.

The tab portion 42 comprises for its part a single wall continuing the radially internal wall 41*p* of the U shaped portion 41: it forms an angle μ relative to the direction normal to the radially external wall 41*d*, i.e. relative to the radial direction. In the present example, this angle μ is approximately 12°.

The U shaped portion 41 is engaged in the notch 35 while the tab portion 42 is pressed and fastened against the radially internal zone 36*a* of the frontal surface 36 by means of welding points 37 accomplished by capacitor discharge. As the distance between the end of the radially external 41*d* and radially internal 41*p* walls of the U shaped portion 41 of the anti-wear device 40 is greater than the width of the notch 35, the U shaped portion 41 is maintained under elastic constraint within the notch 35 and its radially external wall 41*d* is elastically pressed against the radially external surface 35*d* of the notch 35. Moreover, the lengths of the radially external 41*d* and radially internal 41*p* walls of the U shaped portion 41 of the anti-wear device 40 are less than the depth of the notch 35, so that a space 38 remains between the bottom wall 41*f* of the U shaped portion 41 and the bottom 35*f* of the notch 35.

It is then noted that the hook 34 of the sector 32 penetrates into the notch 35 protected by the anti-wear device 40 and is located in position pressed against the radially external wall 41*d* of the U shaped portion 41 of the anti-wear device 40 during the operation of the turbomachine 1, a space being left between the hook 34 and the bottom 41*f* and radially internal 41*p* walls of the U shaped portion 41 of the anti-wear device 40.

An example of the method of repairing a turbomachine according to the disclosure will now be described. It has as its purpose to repair a turbomachine 1 in which the notch 35 of one or more supports 31*m*, 31*v* of the high-pressure compressor 4 have been worn and degraded due to the friction of the hook 34 of a sector 32 in the latter. Concretely, in a worn notch of this type, the dimensions of the notch as well as the surface condition of its internal walls are degraded.

The repair method then comprises a step of machining the internal walls of the worn notch to a sufficient depth to eliminate the faults and smooth the internal wall so as to obtain the original dimensions within a predetermined removal, for example 0.2 mm or 0.4 mm.

An anti-wear device 40 as described above, and in which the thickness of the walls in the U shaped portion corresponds to the depth of this predetermined removal, is then inserted into the notch 35 thus machined in order to restore its original dimensions.

The tab portion 42 of the anti-wear device 40 is then fastened to the radially internal zone 36*a* of the frontal surface 36 by welding points 37 accomplished by capacitor discharge.

The compressor ring 30 is thus repaired.

Once the anti-wear device 40 is thus installed, the hook 34 of the sector 32 wears the anti-wear device 40 but no longer damages the notch 35 of the support 31*m*, 31*v*.

Henceforth, if the anti-wear device 40 reaches too high a level of wear, it is sufficient to remove it and replace it with a new anti-wear device 40 to repair the compressor ring 30. This can be accomplished very easily by inserting a tool into the space 38 located between the anti-wear device 40 and the bottom 35*f* of the notch 35 and using it as a lever to break the welding points 37 one after the other. The new anti-wear device 40 can then be installed in the notch 35 and fastened to the frontal surface 36 in place of the worn anti-wear device 40.

Figure 5:
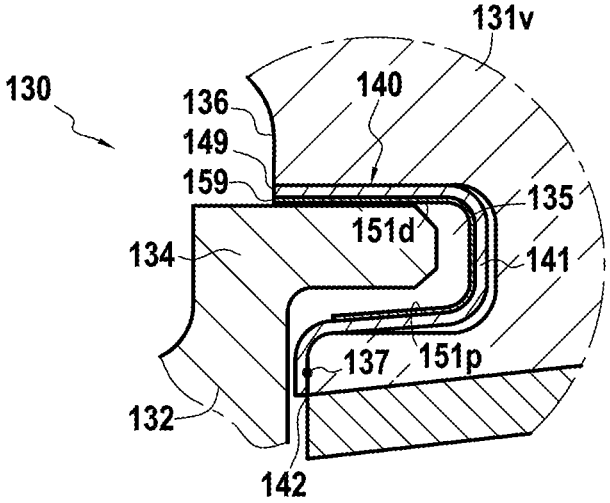
FIG. 5 illustrates a second example of an anti-wear device.

FIG. 5 illustrates a second example of a turbomachine ring 130. This second example is entirely similar to the first example, except that the anti-wear device 140 is different.

In this second example, the anti-wear device 140 comprises a base element 149 and an additional element 159. The base element 149 is formed in a manner completely similar to the anti-wear device 40 of the first example, except that its thickness is smaller.

The additional element 159 is a circular arc section extending continuously and invariantly in the circumferential direction: in FIG. 5, it is shown in section along a transverse plane, i.e. an axial plane in the frame of reference of the turbomachine. It takes the shape of a U complementary to the U-shaped portion 141 of the base element 149. Thus, at rest, the radially internal wall 151*p* of the additional element 159 also forms an angle λ with the direction of its radially external wall 151*d*, i.e. with the axial direction, in such a manner that the additional element is retained in elastic compression within the base element 149 when the latter is engaged in the notch 135 of the support 131*v*.

In the present example, the base element 149 of the anti-wear device 140 is made of a nickel- and/or cobalt-based alloy while the additional element 159 is made of a nickel- and/or cobalt-based alloy: the additional element 159 has a hardness less than both the base element 159 and the hook 134 of the sector 132.

Although the present invention has been described with reference to specific embodiments, it is obvious that modifications and changes can be applied to these examples without departing from the general scope of the invention as defined by the claims. In particular, the individual features of the different embodiments illustrated/mentioned into can be combined into additional embodiments. Consequently, the description and the drawings should be considered in an illustrative, rather than a restrictive sense.

It is also obvious that all the features described with reference to a method are transposable, alone or in combination, to a device, and conversely, all the features described with reference to a device are transposable, alone or in combination, to a method.

The invention claimed is:

1. A turbomachine ring, comprising an essentially cylindrical support, provided to extend around an axial direction of a turbomachine, the support including a frontal surface wherein a notch is formed, the notch comprising a radially internal surface, a bottom and a radially external surface, one or more sectors forming an annulus configured to embody a segment of air stream, each sector comprising a hook portion protruding in the direction of the support and engaging in the notch of the support, and an anti-wear device having a U shaped portion formed by a radially internal wall, a radially external wall, and a bottom wall connecting the radially internal wall to the radially external wall, the U shaped portion provided in the notch of the support and pressed at least against the radially external surface of the notch, and a tab portion, continuously extending the U shaped portion, pressed and fastened against the frontal surface of the support, wherein a space is left between the U shaped portion of the anti-wear device and the bottom of the notch of the support, and wherein the U shaped portion of the anti-wear device is under elastic constraint such that a linearly-extending portion of the radially internal wall of the U shaped portion extends towards the bottom of the notch in a direction that forms an angle with an axial direction in which the radially external wall of the U shaped portion extends.

2. The ring according to claim 1, wherein the tab portion of the anti-wear device is fastened to the frontal surface of the support by welding points.

3. The ring according to claim 2, wherein the welding points are formed by capacitor discharge.

4. The ring according to claim 1, wherein a thickness of the anti-wear device is comprised between 0.1 mm and 1 mm.

5. The ring according to claim 1, wherein the anti-wear device has a hardness less than that of the support and less than that of the hook of the sector.

6. The ring according to claim 1, wherein the anti-wear device comprises a base element having the U shaped portion and the tab portion, and an additional element, in the shape of a U, provided in an interior of the U shaped portion of the base element, wherein the additional element has a hardness less than that of the base element.

7. The ring according to claim 6, wherein the additional element takes the form of a section distinct from the base element, or of a layer deposited on the base element, or of a layer forming a same section with the base element.

8. A turbomachine, comprising a turbomachine ring according to claim 1.

9. The ring according to claim 1, wherein the tab portion of the anti-wear device is under elastic constraint.

10. The ring according to claim 9 wherein the tab portion of the anti-wear device is fastened to the frontal surface of the support by welding points.

11. The ring according to claim 10, wherein the welding points are formed by capacitor discharge.

12. The ring according to claim 11, wherein a thickness of the anti-wear device is between 0.1 mm and 1 mm.

13. The ring according to claim 12, wherein the anti-wear device has a hardness less than that of the support and less than that of the hook of the one or more sectors.

14. The ring according to claim 13, wherein, the anti-wear device comprises a base element having the U shaped portion and the tab portion, and an additional element, in the shape of a U, provided in an interior of the U shaped portion of the base element, and wherein the additional element has a hardness less than that of the base element.

15. The ring according to claim 14, wherein the additional element takes the form of a section distinct from the base element, or of a layer deposited on the base element, or of a layer forming a same section with the base element.

16. A turbomachine, comprising a turbomachine ring according to claim 15.

17. A method for repairing a turbomachine ring, the turbomachine ring comprising an essentially cylindrical support, including a frontal surface wherein a notch is formed, said notch having been at least partially eroded, and one or more sectors forming an annulus configured to embody a segment of air stream, each sector comprising a hook portion protruding in the direction of the support and engaging in the notch of the support, the repair method comprising the following steps:

machining the internal walls of the notch;

placing an anti-wear device having a U shaped portion and a tab portion into the machined notch, the U shaped portion being formed by a radially internal wall, a radially external wall, and a bottom wall connecting the radially internal wall to the radially external wall, a space being left between the U shaped portion of the anti-wear device and a bottom of the notch of the support, and wherein the U shaped portion of the anti-wear device is under elastic constraint such that the radially internal wall of the U shaped portion includes a linear portion that extends towards the bottom of the notch in a direction that forms an angle with a radially internal surface of the notch and an angle with an axial direction in which the radially external wall of the U shaped portion extends; and fastening of the tab portion of the anti-wear device to the frontal surface of the support.

18. A turbomachine ring, comprising an essentially cylindrical support, provided to extend around an axial direction of a turbomachine, the support including a frontal surface wherein a notch is formed, the notch comprising a radially internal surface, a bottom, and a radially external surface, one or more sectors forming an annulus configured to embody a segment of air stream, each sector comprising a hook portion protruding in the direction of the support and engaging in the notch of the support, and an anti-wear device having a U shaped portion formed by a radially internal wall, a radially external wall, and a bottom wall connecting the radially internal wall to the radially external wall by a pair of curved portions at opposite ends of the bottom wall, the U shaped portion provided in the notch of the support and pressed at least against the radially external surface of the notch, and a tab portion, continuously extending the U shaped portion, pressed and fastened against the frontal surface of the support wherein a space is left between the U shaped portion of the anti-wear device and the bottom of the notch of the support;

wherein the U shaped portion of the anti-wear device is under elastic constraint such that a linearly-extending portion of the radially internal wall of the U shaped portion extends towards the bottom of the notch in a direction that forms an angle with the radially internal surface of the notch and an angle with an axial direction in which the radially external wall of the U shaped portion extends;

wherein the tab portion of the anti-wear device is under elastic constraint;

wherein the tab portion of the anti-wear device is fastened to the frontal surface of the support by welding points;

wherein the welding points are formed by capacitor discharge;

wherein a thickness of the anti-wear device is between 0.1 mm and 1 mm;

wherein the anti-wear device has a hardness less than that of the support and less than that of the hook of the sector;

wherein the anti-wear device comprises a base element taking the form of a section having a U shaped portion and a tab portion, and an additional element, in the shape of a U, provided in an interior of the U shaped portion of the base element wherein the additional element has a hardness less than that of the base element; and wherein the additional element takes the form of a section distinct from the base element, or of a layer deposited on the base element, or of a layer forming a same section with the base element.

* * * * *